United States Patent [19]

Schwager et al.

[11] Patent Number: 4,496,100

[45] Date of Patent: Jan. 29, 1985

[54] FLEXIBLE TRACK

[75] Inventors: Frederic A. Schwager; Willis C. Kainsinger, both of Manhattan Beach, Calif.

[73] Assignee: Mattel, Inc., Hawthorne, Calif.

[21] Appl. No.: 434,815

[22] Filed: Oct. 18, 1982

[51] Int. Cl.[3] ..... A63H 18/02

[52] U.S. Cl. ..... 238/10 R; 238/10 F

[58] Field of Search ..... 238/10 R, 10 A, 10 B, 238/10 C, 10 D, 10 F; 104/53, 60, 69, 304, 305, DIG. 1; 198/850, 851; 46/1 K, 216, 257, 259; 273/86 B

[56] References Cited

U.S. PATENT DOCUMENTS

| | | | |
|---|---|---|---|
| 2,675,179 | 4/1954 | Johnson | 238/10 C |
| 3,685,637 | 8/1972 | Bildsoe | 198/850 X |
| 3,730,331 | 5/1973 | Goldberg | 198/850 X |
| 3,807,548 | 4/1974 | Bergeron | 198/850 |
| 4,095,743 | 6/1978 | Birdsall | 238/10 F |
| 4,241,875 | 12/1980 | Vandenbrink | 238/10 F |

FOREIGN PATENT DOCUMENTS

| | | | |
|---|---|---|---|
| 259485 | 1/1949 | Switzerland | 238/10 E |

*Primary Examiner*—Randolph Reese

*Attorney, Agent, or Firm*—John G. Mesaros; Ronald M. Goldman; Max E. Shirk

[57] ABSTRACT

The object of the invention is to provide a flexible track system having a number of identical track sections interconnectable to form curves, banks and slopes, as well as straight segments, each of the sections having an arcuate surface portion with a periphery of a given diameter and an arcuate edge of the same diameter, the edge being configured for proximate engagement with the periphery of the arcuate surface of an adjacent section. Depending ribs are provided at the periphery for frictionally engaging slots in proximate relation to the edge, the slots being elongate for enabling pivotal movement of one section relative to the next. Upwardly diverging sidewalls are configured for overlapping frictional engagement for assisting in maintaining interconnected sections in fixed relation. The arcuate surface portion is deflectable to enable the formation of sloping segments of roadway. Other track sections are provided with mating interconnections on one end thereof for providing interconnection to other types of track sections.

20 Claims, 21 Drawing Figures

FLEXIBLE TRACK

DESCRIPTION

TECHNICAL FIELD

This invention relates to flexible track for toy vehicles, and more particularly to flexible track for gravity powered toy vehicles.

In flexible track arrangements where the track is formed of a number of sections joined together, it is preferable that the junction be free of surface aberration to eliminate vehicle bouncing during travel.

BACKGROUND ART

A flexible track for slot car vehicles is shown and described in U.S. Pat. No. 4,095,743 entitled "Flexible Track for Electrically Energized Miniature Vehicles", issued June 20, 1978 to Birdsall. In the track system of this patent, the track is formed of a plurality of like interconnectable sections, each being narrow in width, and having nesting central arcuate sections interconnected by a pin and hole arrangement adjacent the periphery of the arc, the pin serving as an axis of rotation for angularly displacing one track section relative to the next. Such prior art arrangements provide gaps of varying thickness at the junction.

Another track system for slot car vehicles is shown and described in U.S. Pat. No. 4,241,875 entitled "Flexible Track" issued on Dec. 30, 1980 to Vandenbrink. The track system is formed of a plurality of interconnectable elongate sections with a ball and socket type connection with tapered gaps between adjacent sections.

In such prior art systems, gaps at the junction of adjacent track sections results in a loss of inertia of the vehicle traveling thereover. The track system of the former patent is primarily directed to forming curves in a single plane while the latter patent attempts to create a system which enables uphill and downhill flexing in addition to the formation of curves on a planar surface. However, in both track systems, gaps are present at the junctions of adjacent track sections with the gaps being in the plane of travel of the vehicles.

DISCLOSURE OF INVENTION

In accordance with the present invention, there is provided a track system having a number of interconnectable track sections, the interconnection being provided by a first section having a generally planar arcuately configured portion extending outwardly therefrom, the peripheral edge being provided with a plurality of downwardly depending rib members, the second section having a matingly configured planar portion having an upwardly disposed arcuate edge of the same diameter, the planar portion having arcuately configured slots for releasably receiving therein the ribs for providing pivotable movement between the interconnected sections. The sections are formed of a somewhat resilient material to permit flexing in the plane of travel of the vehicles, with upwardly and outwardly extending sidewalls providing structural strength, the sidewalls being configured for overlapping relation.

BRIEF DESCRIPTION OF THE DRAWINGS

The details of the invention will be described in connection with the accompanying drawings, in which.

BEST MODE FOR CARRYING OUT THE INVENTION

Figure 1:
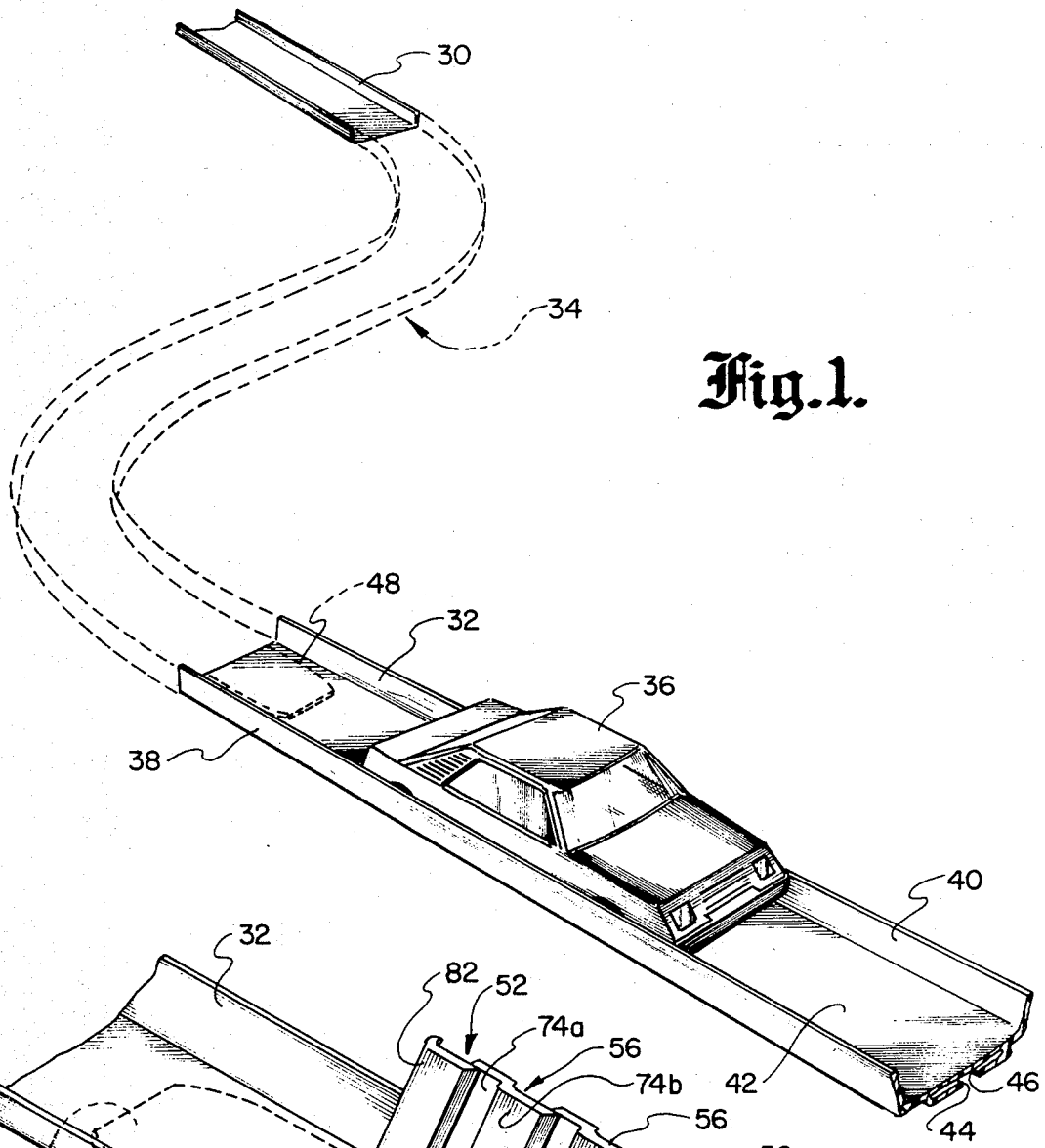
FIG. 1 is a perspective view of a toy vehicle traversing a flexible track system.

Referring now to the drawings, and particularly to FIG. 1, there is shown a track system including first and second "straight" track sections 30 and 32 interconnected with a track segment 34, shown in dotted lines in the form of a tortuous segment, the track system being configured for travel thereover of a toy vehicle 36. The toy vehicle 36 is a gravity powered (that is, non-motorized) vehicle. The vehicle 36, as well as the "straight" track sections 30 and 32 may be of the type sold under the trademark "Hot Wheels". The track sections 30 and 32 are formed in one piece of a plastic material, and by reference particularly to section 32 include upwardly extending shoulder portions 38 and 40 on either side of the "road" surface 42 for assisting in maintaining the vehicle on the road 42. The undersurface of the section 32 has longitudinally extending opposing facing grooves 44 and 46 formed therein for receiving tongues for interconnection to adjacent sections, one such tongue 48 being shown in dotted lines at the connection to the flexible track segment 34. The tongues 48 may be separate pieces for interconnecting two "straight sections, or may be integrally formed with an adjacent section in accordance with the track sections to be described.

Figure 2:
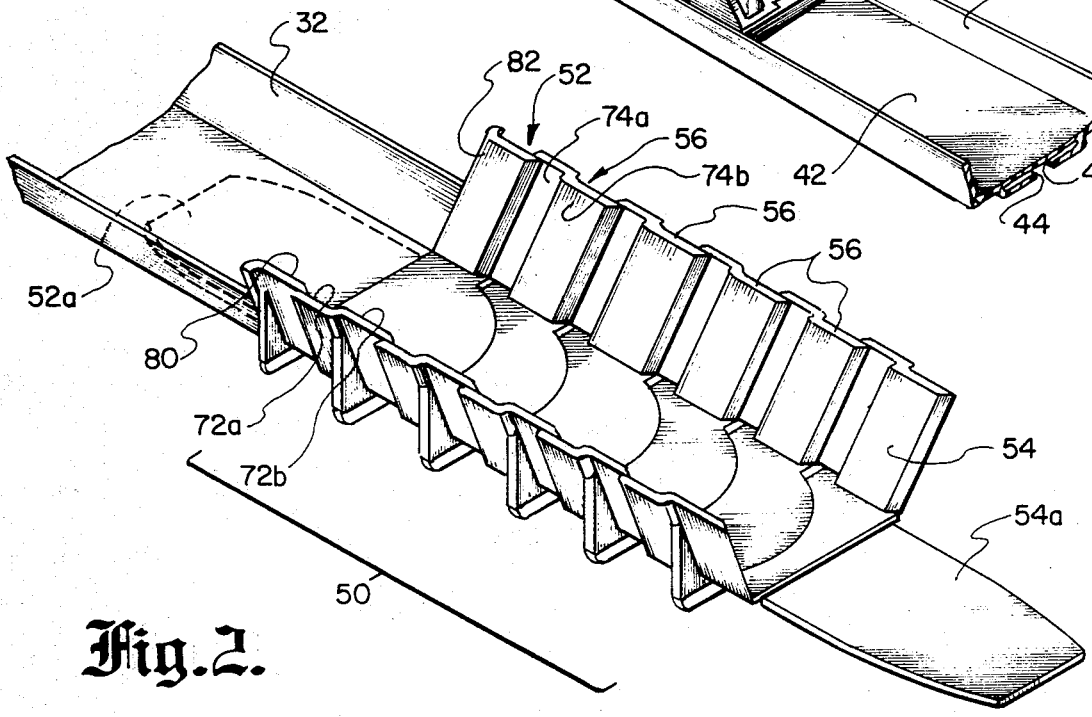
FIG. 2 is a perspective view of a flexible track segment according to the invention.

Referring now to FIG. 2, there is shown a track segment, generally designated 50, which may be interconnected to a straight track section 32. The segment 50 includes a plurality of interconnected sections, there being three configurations of sections with matingly configured interconnect means. At opposite ends of the segment 50 are the track sections 52 and 54 which are specifically configured for interconnection to the straight track sections 32 and 34 with the intervening track sections 56 all being identically configured. Each of the track sections 52 and 54 include tongue portions 52*a* and 54*a*, respectively, for matingly engaging the grooves, such as grooves 44 and 46 of the straight sections.

FIGS. 5 through 9 illustrate the main section 56 which is formed in one piece of a plastic material having a certain amount of flexibility, the section 56 including first and second generally parallel planar portions 58 and 60. The planar portion 60, in plan view, is generally arcuate at a given diameter, with the portion 58 having an edge 62, which is arcuate through substantially the same diameter. As better illustrated in FIG. 7, the portion 58 lies in a plane below, and parallel to, the portion 60 with the height of the edge 62 generally corresponding to the thickness of the arcuate upper surface portion 60.

Figure 5:
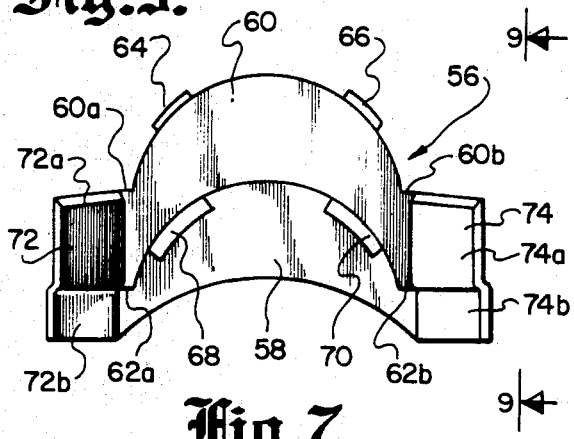
FIG. 5 is a top plan view of a track section according to the invention.
Figure 6:
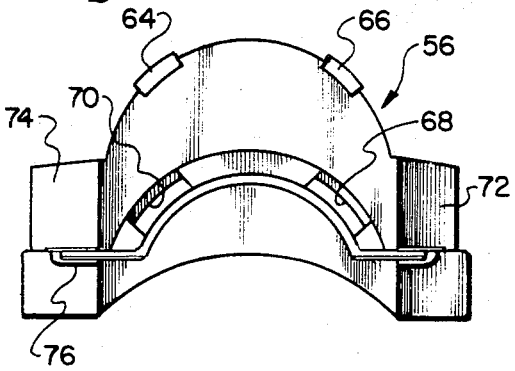
FIG. 6 is a bottom view of the track section of FIG. 5.

Integrally formed with, and depending from the perimeter of the upper arcuate portion 60 are first and second generally L-shaped rib members 64 and 66, which are slightly resilient and configured for snap-fit engagement within truncated arcuate slots of an adjacent section, such as slots 68 and 70 of section 56, the slots being provided with depending walls which are formed in the lower surface portion 58 in proximity to the edge 62 at positions corresponding to the positions of rib members 64 and 66. As shown in FIGS. 5 and 6, the slots 68 and 70 extend through an arc greater than the width of rib members 64 and 66 to enable a limited amount of angular movement between adjacent track sections, as will hereinafter be described. With the rib members 64 and 66 within slots 68 and 70, the frictional fit maintains adjacent sections in alignment, with the friction between adjacent surfaces existing over a large area at a distance from the center of pivoting. This large radius improves the rigidity of the assembled track by application of the frictional force at a large torque moment.

Figure 7:
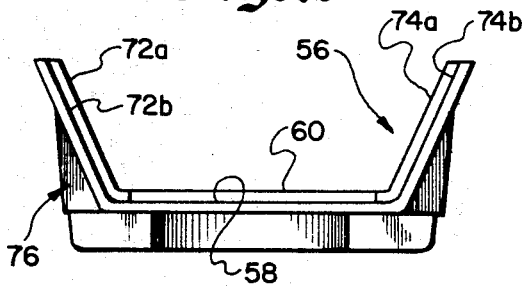
FIG. 7 is an end view of the track section of FIG. 5.
Figure 8:
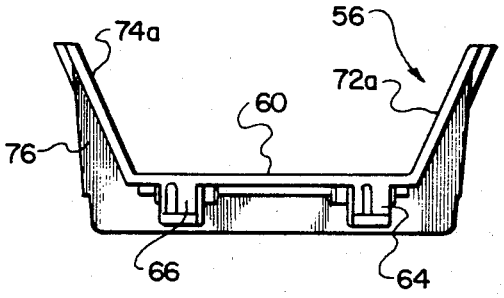
FIG. 8 is an opposite end view of the track section of FIG. 5.

Extending upwardly and outwardly from the portions 58 and 60 are first and second sidewalls 72 and 74, each of the sidewalls having first and second portions offset from one another. For example sidewall 72 has a first portion 72*a* stepped inwardly from portion 72*b* with portions 74*a* and 74*b* being in opposing relation to the two portions of sidewall 72. The amount of offset between portions 72*a* and 74*a*, as a pair, compared with portions 72*b* and 74*b* is sufficient to enable the sidewalls to overlap or telescope somewhat when assembled. The upwardly diverging sidewalls are integrally formed with the surface portions 58 and 60, and as can be seen in FIG. 7, the sidewalls and the surface portions are continuous. On the outer surface of the sidewalls 72 and 74 there is formed an integral reinforcing web structure 76 at about the junction of the two sidewall portions, the structure 76 extending beneath the surface portions 58 and 60 as well.

Figure 3:
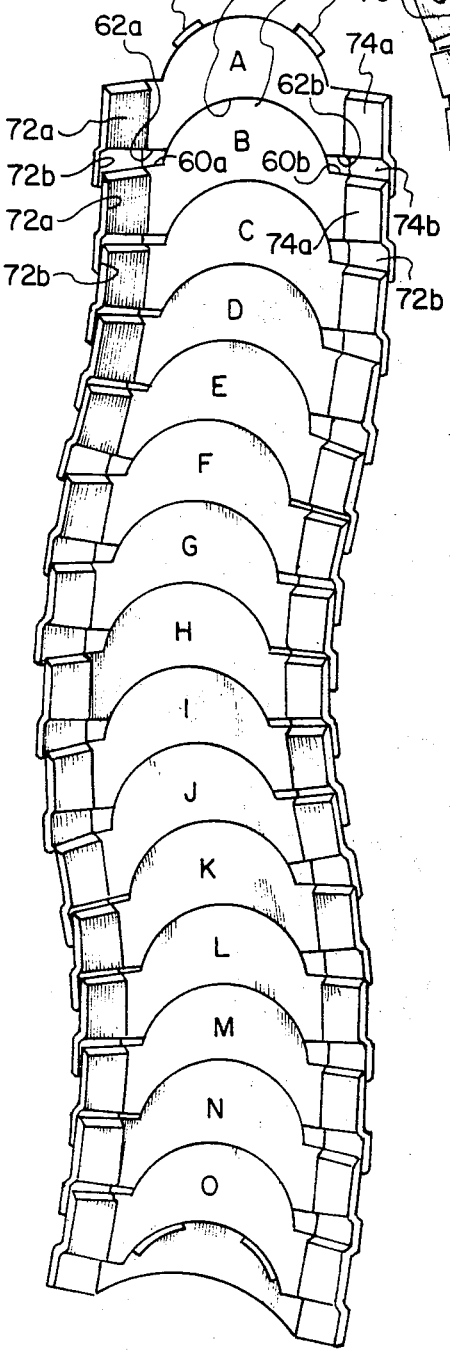
FIG. 3 is a top plan view of a flexible track segment according to the invention.

As best shown in FIGS. 5 and 6, the arcuate surface portion 60 extends substantially across the roadway portion with opposite edges of the portion 60, such as edge portions 60*a* and 60*b* being linear and extending at an angle rearwardly from the leading edge of the portion 60. Similarly, the edge 62 terminates with two linear edge portions 62*a* and 62*b*, which may lie in the same line, or be angled slightly forwardly of this line. As illustrated in FIGS. 2 and 3, when several sections 56 are interconnected, the linear edges 60*a* and 62*a* lie in proximate relation with and define an angular gap, the angle of which varies with the degree of pivoting of the adjacent sections 56 relative to one another. This configuration provides a degree of freedom of movement or pivoting in the plane of the surface portion 60 with very small gaps out of the path of travel of a vehicle 36. In addition, to provide for flexing in the third dimension, that is for forming hills, by reference to FIGS. 5, 6 and 9, it can be seen that the arcuate surface portion 60 extends out from the main structurally reinforced portion of the track section 56, this structurally reinforced portion being the portion including the sidewalls 72 and 74 as well as the lower supporting structure 76. This configuration essentially provides a deflectable plate which includes the L-shaped rib members 64 and 66, which plate can deflect, or "give" through a small angle to facilitate the formation of slopes and hills when interconnecting a number of such sections together.

Figure 10:
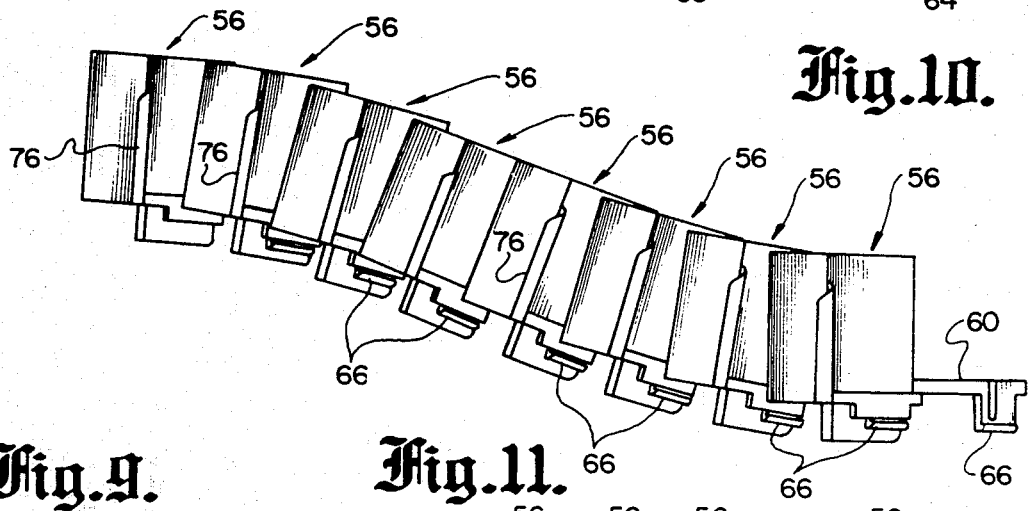
FIG. 10 is a side elevational view of a track segment consisting of a number of the track sections of FIG. 5 interconnected to form a slope.
Figure 9:
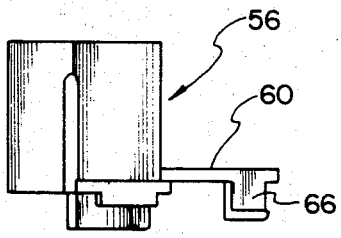
FIG. 9 is a side elevational view of the track section of FIG. 5 as viewed along line 9—9 thereof.
Figure 11:
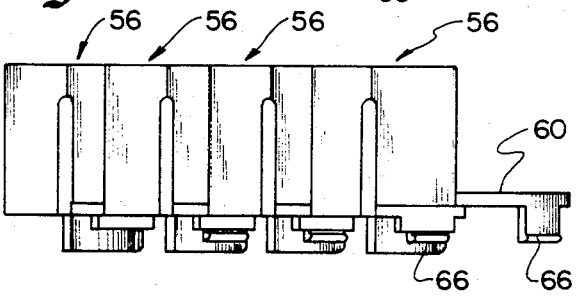
FIG. 11 is a side elevational view of a track segment consisting of a number of the track sections of FIG. 5 interconnected to form a straight segment of track.
Figure 12:
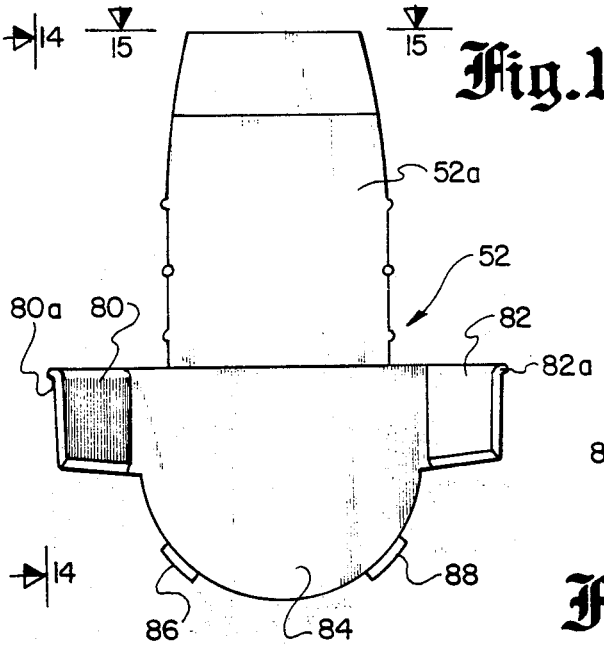
FIG. 12 is a top plan view of an alternate track section according to the invention.
Figure 13:
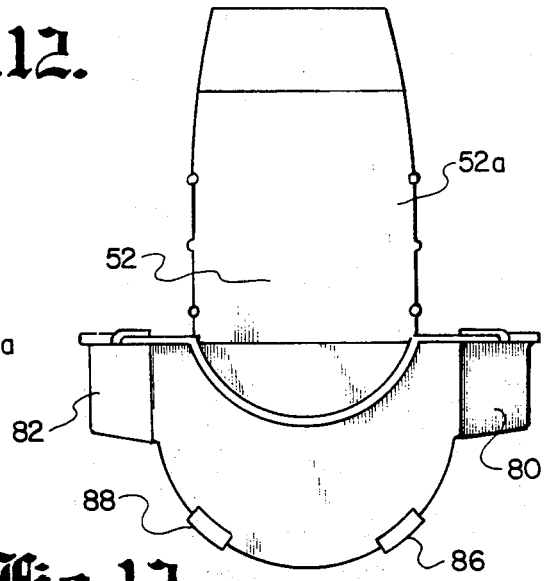
FIG. 13 is a bottom view of the track section of FIG. 12.
Figure 14:
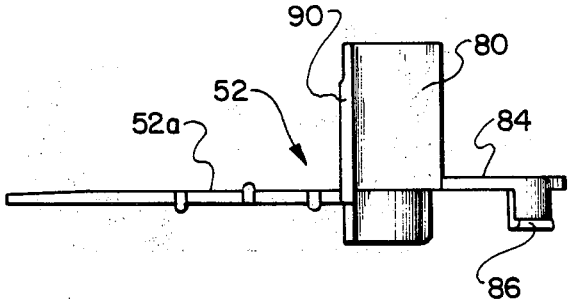
FIG. 14 is a side elevational view of the track section of FIG. 12 as viewed along line 14—14 thereof.
Figure 15:
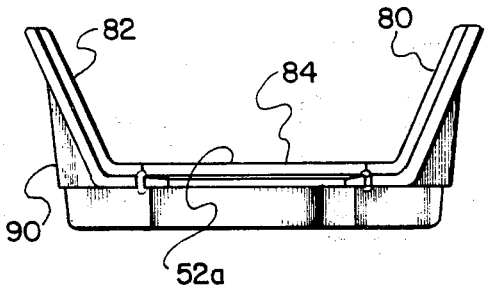
FIG. 15 is an end view of the track section of FIG. 12 as viewed along line 15—15 thereof.
Figure 16:
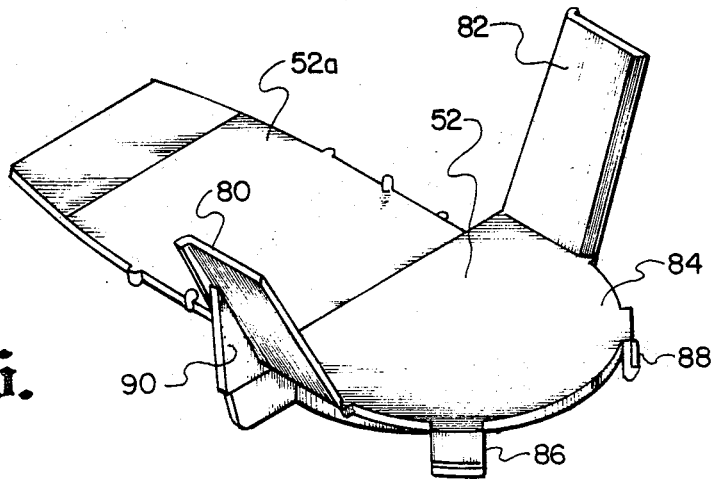
FIG. 16 is a perspective view of the track section of FIG. 12.
Figure 17:
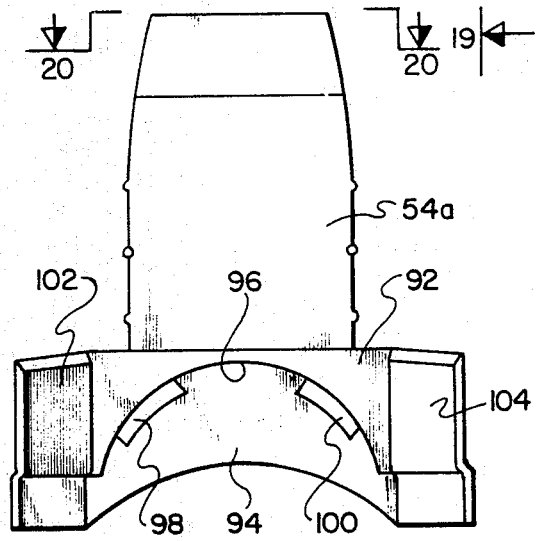
FIG. 17 is a top plan view of another alternate track section according to the invention.
Figure 18:
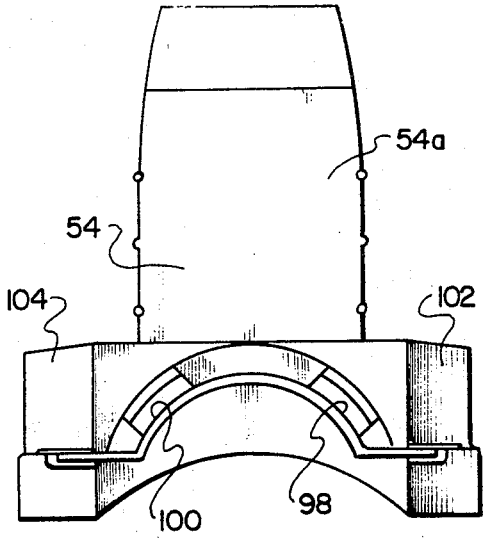
FIG. 18 is a bottom view of the track section of FIG. 17.
Figure 19:
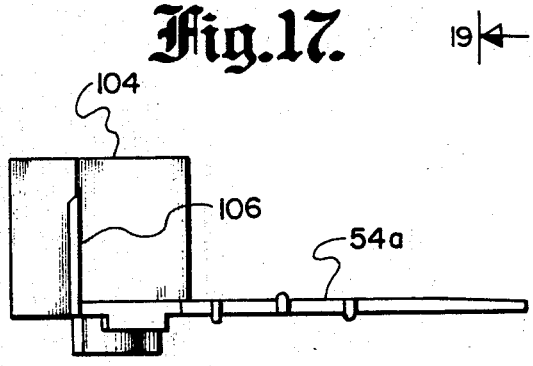
FIG. 19 is a side elevational view of the track section of FIG. 17 as viewed along line 19—19 thereof.
Figure 20:
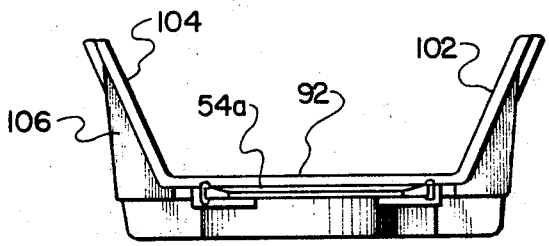
FIG. 20 is an end view of the track section of FIG. 17 as viewed along line 20—20 thereof.
Figure 21:
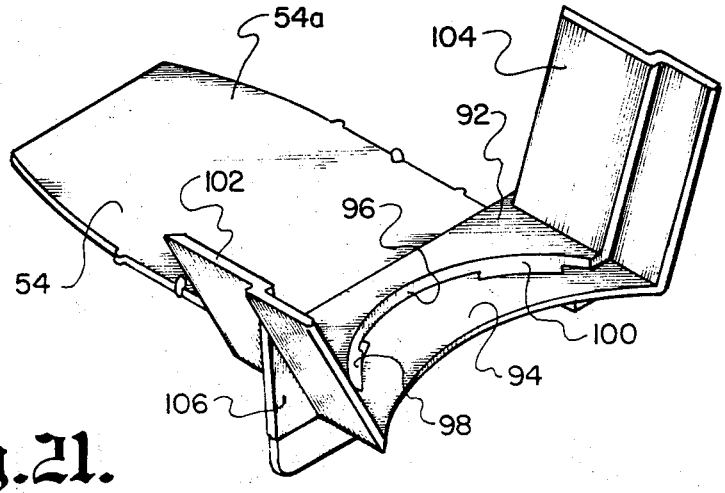
FIG. 21 is a perspective view of the track section of FIG. 17.

Referring now to FIGS. 2 through 4 and 10 and 11, a number of sections 56 are interconnected and disposed in different ways. For example in FIGS. 3 and 4, a plurality of sections 56 are interconnected and disposed to form a serpentine or tortuous roadway, in which all vehicle traveling surfaces 60 are arranged in a common plane. FIG. 10 illustrates a number of sections 56 connected to form a slope or hill, while FIG. 11 shows a number of sections 56 interconnected to form a straight segment. FIG. 2, as previously discussed includes not only the interconnected sections 56, but alternate track sections 52 and 54 which provide for interconnection to conventional straight track sections, such as section 32.

Figure 4:
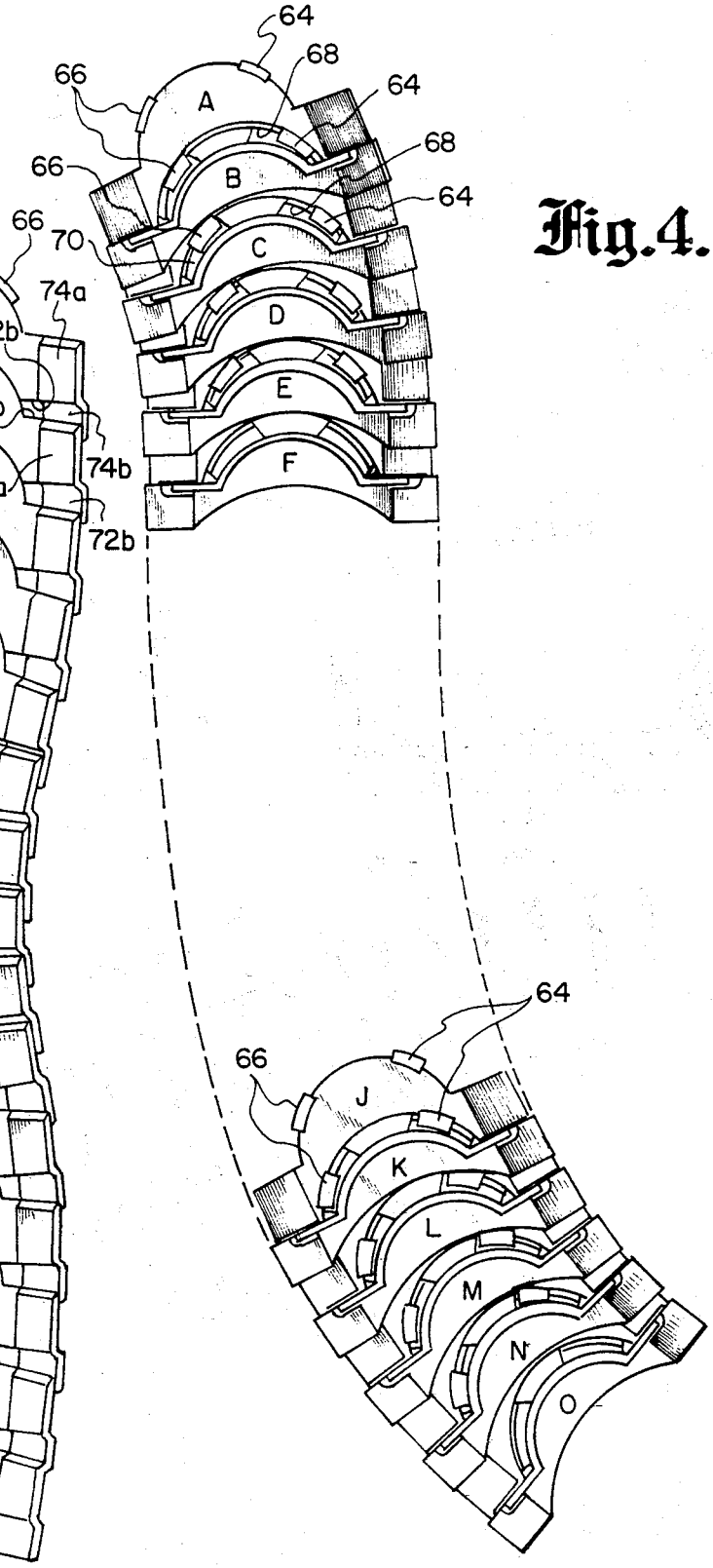
FIG. 4 is a bottom plan view of the track segment of FIG. 3.

Referring first to FIGS. 3 and 4, the individual track sections 56 have additionally labelled thereon the capital letters A through O, which letters will be used as suffix designations during the discussion of this arrangement. Taking the upper two sections, the track section 56B has the rib members 64 and 66 thereof inserted into the arcuate slots 68 and 70 respectively of track section 56A (see FIG. 4) with the leading periphery of arcuate surface portion 60 in abutting engagement with edge 62 of section 56A. On either side of the junction of the arcs, there are angular gaps. For example, on the left, as viewed in FIG. 3, the edge 62*a* of section 56A forms an angle relative to the proximate edge 60*a* of section 56B. Similarly on the opposite side of the arcuate portion 60, an angular gap is formed by the edge 62*b* of section 56A being angularly oriented relative to the proximate edge 60*b* of the section 56B. Correspondingly, the sidewalls 72 and 74 are configured and dimensioned so that sidewall portion 72*a* of section 56B overlies the adjacent sidewall portion 72*b* of section 56A, with the opposite wall portions 74*a* and 74*b* of the two adjacent sections likewise being in overlapping sliding relation. The dimensioning is such that the sections 56A and 56B can be pivoted relative to one another through an angle limited by the arc of the slots 68 and 70 without the sidewalls 72 and 74 interfering, while providing lengthwise structural stability to the track segment. The configuration of the rib members 64 and 66 and the slots 68 and 70 with the walls depending therefrom provides a tight frictional engagement along the arc of the portion 60 at the junction with the adjacent surface portion 58 to fix the parts in the pivoted position during travel of vehicles thereover.

The angular gap on either side of the arc varies according to the amount of pivoting. For example, sections 56A and 56B are in general alignment with the gaps generally equal. Section 56E, on the other hand, is pivoted clockwise relative to section 56F, resulting in the gap on the right (as viewed in FIG. 3) being at a minimum, with the gap on the left at a maximum. The opposite is true with respect to the gaps at the intersection of sections 56J and 56K. As interconnected, the edge of portion 60 lies in abutting, or proximate relation with the edge 62 over the entire arc thereof to provide a continuous surface in the plane of travel of a vehicle thereover.

With the forces resulting from travelling vehicles on the track, prior art track sections were prone to being repositioned due to the lack of adequate friction at the point of interconnection. For example, in prior art U.S. Pat. No. 4,095,743, a pivot pin type of connection is provided at the pivot point, thus resulting in friction being applied over a small area. In contrast to this, by reference to FIG. 4, it can be seen that during pivoting of adjacent sections, the frictional engagement of the rib members 64 and 66 with the slots 68 and 70 is at the circumference, at a distance from the pivot point, thus resulting in greater friction being applied to maintain the parts in position. With the coupling of the above prior art patent, upon pivoting, gaps are automatically created. In contrast with the instant invention, since the sliding frictional fit is at the circumference, no such gaps are created upon pivoting.

In accordance with the present invention, with the snap-fit rib members 64 and 66 within slots 68 and 70, the frictional engagement between adjacent track sections extends over the entire length of the arc defined by the junction of the periphery of the arcuate portion 60 with the adjacent surface of portion 58. There is no mechanical coupling on the axis or center of pivoting, thus providing flexibility in the third dimension for creating slopes. In addition, the frictional engagement between the overlapping sidewalls provides stability in the X and Y-planes, as well as the Z-plane. In brief, once the adjacent sections 56 are positioned, frictional engagement of the coacting parts will assist in maintaining the positions, as fixed.

FIG. 11 illustrates, in side elevation, a number of sections 56 interconnected to form a straight track segment. As can be seen, the upwardly extending parts of the web structure 76 are generally parallel, with the amount of overlap between adjacent sidewall portions being generally equal. In FIG. 10, a greater number of sections 56 have been interconnected to form a slope. In this arrangement, as viewed from the side, there is an angular difference between the web structures 76, with the positions of adjacent sections 56 being maintained by the overlapping sidewall configuration. Any deflection required for this positioning is effected in the plate formed by the arcuate portions 60 with the junction of its periphery being maintained by the interconnecting devices at this periphery. In essence, the transition on the roadway over this junction will be smooth because of the interlock at the junction itself.

As shown in FIG. 2, the track segment thereof includes not only a number of interlocking sections 56, but two other sections 52 and 54 having a mating interlock means with a means for interconnection to conventional straight track sections 32 and 34. The track section 52 is more fully illustrated in FIGS. 12 through 16, while the track section 54 is more fully illustrated in FIGS. 17 through 21.

Referring now to FIGS. 2 and 12 through 16, the details pertaining to track section 52 will be discussed. Track section 52 is essentially a truncated version of the track section 56 with means for interconnection to the grooves 44 and 46 of the conventional straight track sections, such as track sections 32 and 34. As shown, the interconnection means includes the tongue portion **52*a* which lies in a plane parallel to, and below the plane of travel of the vehicle, this plane being the arcuate portion 84 which has the periphery thereof configured identically to the arcuate portion 60 of the track section 56, with the downwardly depending generally L-shaped rib members 86 and 88 likewise being identically configured and arranged to correspond to the rib members 64 and 66 of the section 56. However, the upwardly divergent sidewalls 80 and 82 are slightly differently configured inasmuch as the sidewalls 80 and 82 are of a dimension and configuration substantially the same as the sidewall portions 72*a* and 74*a* of the sidewalls 72 and 74. That is, the sidewalls 80 and 82 are generally plate shaped in a single plane and do not include the "offset" wall portion. The coaction of sidewalls 80 and 82 with the adjacent sidewall portions 72*b* and 74*b* of section 56 is shown in FIG. 2. The leading edges 80*a* and 82*a* of sidewalls 80 and 82 are curved outwardly, the purpose of which is to assist vehicles entering the track segment formed as shown in FIG. 2. The track section 52 is formed in one piece and includes the web structure 90 extending down the exterior of the sidewalls 80 and 82 and beneath the surface 84, this structure being similar to the web structure 76 of the track section 56**.

Referring now to FIGS. 2 and 17 through 21, the track section 54 will now be described, and this section again is somewhat of a truncated version of one of the sections 56. For interconnection to the grooves 44 and 46 of a conventional straight track section 32 or 34, there is provided a tongue portion **54*a* lying in a plane generally parallel to a planar surface 92 over which the vehicle travels. A second surface 94 lies on the side opposite the tongue portion 54*a* in a plane parallel to the surface 92 with the junction therebetween being a shoulder or edge 96 of arcuate configuration identically configured to edge 62 of section 56. Arcuate slots 98 and 100 extend through the surface 94 adjacent the edge 96 for releasably receiving therein the L-shaped rib members 64 and 66 of a section 56. Extending in an upwardly diverging direction from the plane of the surface 92 are opposing offset sidewalls 102 and 104, which are configured generally identically to sidewalls 72 and 74 of section 56. Structural rigidity for the one-piece assembly is likewise provided by a reinforcing web structure 106, which is functionally and dimensionally similar to web structure 76 of section 56**.

With respect to track sections 52 and 54, the short edges extend generally radially outwardly from the periphery of arcuate surface portion 84 of section 52 and the edge 96 of section 54, with these short edges being angularaly disposed at angles substantially similar to the angles of edges **60*a* and 60*b*, as well as 62*a* and 62*b***, to provide the angular gaps previously described.

In accordance with the present invention, there is shown and described a track system having flexibility in two ways, the first being in a horizontal plane, and the second being in a vertical plane. The track sections 56, 52 and 54 are configured so that friction between adjacent interlocked sections is provided by the rib members 64 and 66 being positioned at the periphery of the edge of arcuate portion 60, with this friction being applied over the entire length of the arc at the junction with the surface of portion 58 due to the downward force being applied by the lower legs of the rib members 64 and 66 in engagement with the lower edges of the walls of the slots 68 and 70. In addition, the sidewalls are configured for providing overlapping frictional engagement with the sidewalls of adjacent sections for enabling the formation of free-standing curves and slopes, once positioned. With the curve of the arcuate surface 60 extending substantially across the roadway, the minimal angular gaps at opposite ends thereof provide virtually no interference with the travel of the vehicle 36 thereover.

With the configuration thus shown and described, frictional engagement is provided not only in the plane of pivoting, but in the plane of each of the overlapping junctions of the sidewalls, thus permitting flexible track systems including curves, banks, slopes and loops, as well as straight segments, all of which will remain in position once fixed.

While there has been shown and described a preferred embodiment, it is to be understood that various other adaptations and modifications may be made within the spirit and scope of the invention.

We claim:

1. In a track system for forming a roadway for travel thereon of miniature vehicles, the combination comprising:

at least a first and second track sections;

means on said first track section including an arcuate surface portion having rib means in depending relation to the periphery thereof; and means on said second track section including a first surface portion having slot means therein configured for interlocking relation with said rib means and a second surface portion having an arcuate edge of substantially the same radius as the edge of said arcuate surface portion, the two edges being in proximate relation with the sections interlocked with said second surface portion and the surface of said arcuate surface portion defining part of the roadway, said rib means and said slot means being so dimensioned and configured for enabling pivoting between adjacent sections when so interconnected while providing friction for maintaining the pivoted position once fixed.

2. The track system of claim 1 wherein each of said track sections further includes opposed sidewalls in upwardly diverging relation, said sidewalls being configured for overlapping engagement with said first and second track sections interconnected.

3. The track system of claim 2 wherein said arcuate surface portion is deflectable for enabling the forming of a slope with a number of sections interconnected.

4. The track system of claim 2 wherein said sidewalls have first and second offset wall portions configured for frictional engagement.

5. The track system of claim 4 wherein said first and second track sections are identical, and each of said track sections is formed in one piece of a somewhat flexible material.

6. The track system of claim 5 wherein said arcuate surface portion is deflectable for enabling the forming of a slope with a number of said sections interconnected.

7. The track system of claim 1 wherein said first and second track sections are identical for interconnection to a number of like sections to form a continuous roadway.

8. The track system of claim 1 wherein said slot means are in proximate relation to said arcuate edge.

9. The track system of claim 8 wherein there are two rib means and two slot means.

10. In a track system having a number of generally identically configured track sections interconnectable for forming a roadway for travel thereon of miniature vehicles, each of said track sections comprising:

an arcuate surface portion having the periphery thereof on a curve of a given diameter;

a second surface disposed below and generally parallel to said arcuate surface portion, said second surface having an arcuate edge at the junction with said arcuate surface portion, the curve of said edge being on a curve of said given diameter;

rib means in depending relation with said periphery; and slot means in said second surface in proximate relation to said edge, said slot means and said rib means being so dimensioned and configured for interlocking relation with an adjacent like track section while enabling pivoting between adjacent sections when so interconnected while providing friction for maintaining the pivoted position once fixed.

11. The track system of claim 10 wherein each track section further includes sidewall means configured for overlapping frictional engagement with the sidewall means of an adjacent track section.

12. The track system of claim 11 wherein said sidewall means includes opposing sidewalls diverging upwardly from said arcuate surface portion.

13. The track system of claim 12 wherein each of said sidewalls includes a first sidewall portion and a second sidewall portion in a generally parallel plane offset therefrom an amount generally equal to the thickness of the first sidewall portion.

14. The track system of claim 10 wherein each section includes two rib means and two slot means.

15. The track system of claim 14 wherein each of said rib means is a generally L-shaped rib member and each of said slot means is an arcuate slot having an arc greater than the width of said rib member.

16. The track system of claim 15 wherein said arcuate surface portion is at least partially deflectable for enabling the formation of sloping roadway segments with a number of said track sections interconnected.

17. The track system of claim 16 wherein each of said track sections includes sidewall means configured for overlapping frictional engagement with the sidewall means of an adjacent track section.

18. The track system of claim 17 wherein each of said track sections is formed in one piece from a somewhat flexible material.

19. The track system of claim 18 wherein said sidewall means includes opposing sidewalls diverging upwardly from said arcuate surface portion.

20. The track system of claim 19 wherein said track section further includes a web structure integrally formed on the exterior of said sidewalls for providing reinforcement thereof.

* * * * *